US005740609A

United States Patent [19]

Jurus

[11] Patent Number: 5,740,609

[45] Date of Patent: Apr. 21, 1998

[54] METHOD OF MAKING ONE-PIECE VEHICLE WHEELS AND THE LIKE

[75] Inventor: Kevin D. Jurus, Lansing, Mich.

[73] Assignee: Motor Wheel Corporation, Okemos, Mich.

[21] Appl. No.: 569,499

[22] Filed: Dec. 8, 1995

[51] Int. Cl.[6] ..... B21H 1/02; B21H 1/04

[52] U.S. Cl. ..... 29/894.324; 29/984.325; 72/84

[58] Field of Search ..... 29/984.324, 984.325; 72/83, 84, 68; 301/63.1

[56] References Cited

U.S. PATENT DOCUMENTS

| | | | |
|---|---|---|---|
| 2,075,294 | 3/1937 | LeJeune . | |
| 3,264,719 | 8/1966 | Adams et al. . | |
| 3,270,402 | 9/1966 | Adams et al. . | |
| 3,672,021 | 6/1972 | Schulte et al. . | |
| 3,822,458 | 7/1974 | Schulte et al. . | |
| 4,035,891 | 7/1977 | Lucas et al. . | |
| 4,048,828 | 9/1977 | Lucas et al. . | |
| 4,055,068 | 10/1977 | Lucas et al. . | |
| 4,388,817 | 6/1983 | Victor . | |
| 4,528,734 | 7/1985 | Beyer . | |
| 4,532,786 | 8/1985 | Schaible . | |
| 4,554,810 | 11/1985 | Jurus | 29/894.324 |
| 4,606,206 | 8/1986 | Daudi | 72/83 |
| 4,624,038 | 11/1986 | Walther . | |
| 4,637,112 | 1/1987 | Asari et al. . | |
| 4,936,129 | 6/1990 | Lipper et al. . | |

FOREIGN PATENT DOCUMENTS

| | | |
|---|---|---|
| 1186248 | of 1957 | France . |
| 1068654 | of 1959 | Germany . |
| 3410308 | of 1985 | Germany . |
| 58337 | of 1981 | Japan . |

*Primary Examiner*—P. W. Echols
*Attorney, Agent, or Firm*—MacMillan, Sobanski & Todd

[57] ABSTRACT

A method of making one-piece vehicle wheels and the like includes providing a generally circular blank from sheet stock. The blank is preferably preformed with a center portion in the final shape of the disc portion of the wheel, and a peripheral portion for spin shaping the final shape of the rim portion of the wheel. The preformed blank is positioned between an outer mandrel and an inner mandrel having a fixed outboard surface, and an inboard shaping surface which conforms to the final shape of at least a portion of the rim well and the inboard bead seat and flange. An inboard section of the blank peripheral portion is spin formed against the inboard shaping surface of the inner mandrel to form the final shapes of at least a portion of the rim well and the inboard bead seat and flange. An outboard section of the blank peripheral portion is spin formed by engaging the same with a forming roller while the associated portion of the blank peripheral portion remains spaced apart from and unsupported by the fixed outboard surface of the inner mandrel to form the final shape of the outboard bead seat.

36 Claims, 11 Drawing Sheets

METHOD OF MAKING ONE-PIECE VEHICLE WHEELS AND THE LIKE

BACKGROUND OF THE INVENTION

The present invention relates to the manufacture of vehicle wheels and the like, and in particular to a method of spin forming one-piece wheels.

One-piece vehicle wheels of the type having integrally formed disc and rim portions have become increasing popular due largely to their appearance and inherent strength. Heretofore, one-piece wheels have typically been manufactured by casting or drop forging processes, which are relatively slow and expensive, at least when compared to the manufacture of conventional welded wheels. Both casting and forging manufacturing techniques require substantial capital investment, and are not particularly well suited for making specialty, low volume wheel designs.

SUMMARY OF THE INVENTION

One aspect of the present invention is a unique spin forming method for forming one-piece vehicle wheels. A generally circular blank is provided having a center portion with the final shape of at least a portion of the disc portion of the wheel, and a peripheral portion for spin forming the final shape of at least a portion of the rim portion of the wheel. The blank is positioned between inner and outer mandrels, wherein the inner mandrel has a fixed inboard surface, and an outboard shaping surface which conforms to the final shape of at least a portion of the rim well and the inboard bead seat and flange. An inboard section of the blank peripheral portion is spin formed against the inboard shaping surface of the inner mandrel to form the final shapes of at least a portion the rim well and the inboard bead seat and flange. An outboard section of the blank peripheral portion is spin formed by engaging the same with a forming roller while the associated portion of the blank peripheral portion remains spaced apart from and unsupported by the fixed outboard surface of the inner mandrel to form the final shape of at least a portion of the outboard bead seat.

Preferably, the blank is formed from aluminum sheet stock of the type having a substantially uniform thickness. The peripheral portion of the blank may be spin formed by engaging the same with a forming roller while the blank peripheral portion remains spaced apart from and unsupported by the inner mandrel, so as to obtain controlled thickness reduction in the unsupported peripheral portion of the blank. Furthermore, a raised shoulder portion of the blank is spin formed against the shaping surface of the outer mandrel to form the final shape of at least a portion of the outboard retaining flange. The spin forming method permits one-piece wheels to be formed in a single spinning operation, without requiring complex and expensive mandrels with expandable inserts, etc., which require costly maintenance.

The principal objects of the present invention are to provide a unique, low cost method of spin forming one-piece vehicle wheels and the like. A wheel blank is formed from sheet stock, and is spin formed in a single spinning operation to reduce manufacturing costs. The spin forming technique employs mandrels with fixed forming surfaces, which minimizes their associated manufacturing cost, as well as repair expenses. The spin forming machine can be easily programmed to form different shapes, such that the present method is especially suited for making specialty and/or low volume wheel designs. The present method is very efficient, and particularly well adapted for manufacturing one-piece type vehicle wheels.

These and other advantages of the invention will be further understood and appreciated by those skilled in the art by reference to the following written specification, claims and appended drawings.

DETAILED DESCRIPTION OF THE PREFERRED EMBODIMENTS

Figure 7:
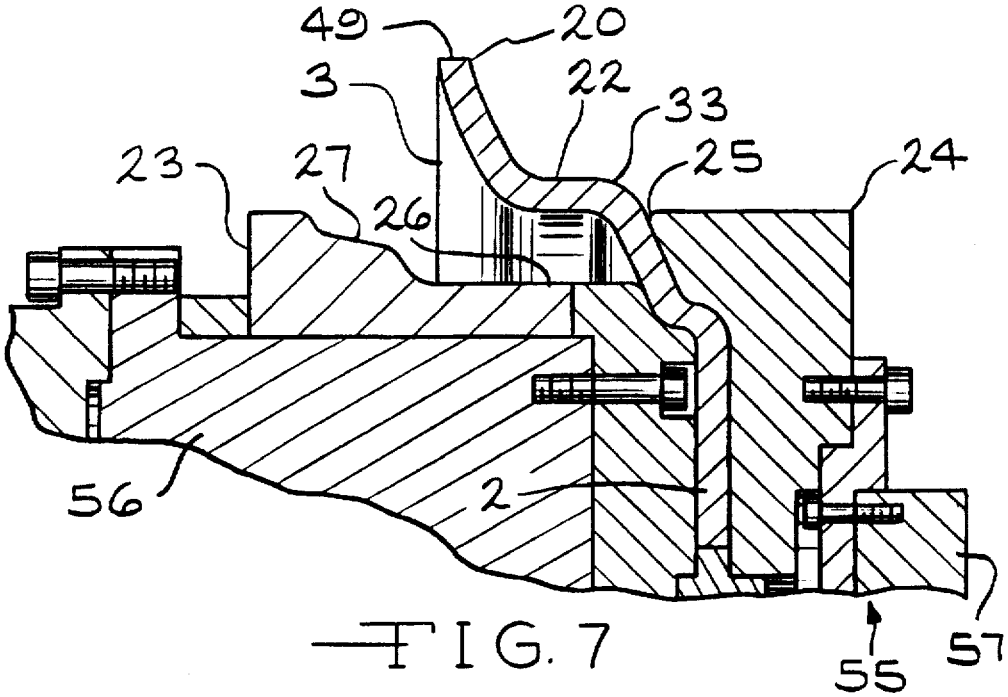
FIG. 7 is a partially schematic, cross-sectional view of the preformed blank installed in a spin forming machine, shown before any spin forming operation is performed.

For purposes of description herein, the terms "upper," "lower," "right," "left," "rear," "front," "vertical," "horizontal," "axial," "circumferential" and derivatives thereof shall relate to the invention as oriented in FIGS. 6 and 7. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIGS. 1 and 2) generally designates a one-piece vehicle wheel manufactured in accordance with the present process. Wheel 1 is of the type having a disc portion 2 and an integral rim portion 3 with inboard and outboard bead seats 4 and 5 and associated retaining flanges 6 and 7, respectively, and a rim well 8 therebetween.

The present method includes forming a generally circular blank 19 (FIGS. 3 and 4) from sheet stock or the like of the type having a substantially uniform thickness. Circular blank 19 is preferably preformed into the blank 20 illustrated in FIG. 5, with a center portion 21 in the final shape of at least a portion of the disc portion 2 of wheel 1, and a peripheral portion 22 for spin shaping the final shape of at least a portion of the rim portion 3 of wheel 1. The preformed blank 20 is positioned between the inner and outer mandrels 23 and 24 respectively, of a spin forming machine 55, as shown in FIGS. 7–18. The outer mandrel 24 (FIG. 7) has a shaping surface 25 which conforms to the final shape of at least a portion of the outboard retaining flange 7. The inner mandrel 23 has a fixed outboard surface 26, and an inboard shaping surface 27 which conforms to the final shape of at least a portion of the rim well 8 and the inboard bead seat 4 and flange 6.

Preferably, the peripheral portion 22 of blank 20 is first spin formed by engaging the same with a forming roller while the blank peripheral portion 22 remains spaced apart from and unsupported by the outboard and inboard shaping surfaces 26 and 27 of inner mandrel 23, so as to obtain controlled thickness reduction in the unsupported peripheral portion 22 of the preformed blank 20. An inboard section 31 (FIG. 6) of the blank peripheral portion 22 is spin formed against the inboard shaping surface 27 of the inner mandrel 23 to form the final shapes of at least a portion of the rim well 8 and the inboard bead seat 4 and flange 6. An outboard section 32 of the blank peripheral portion 22 is spin formed by engaging the same with a forming roller while the blank peripheral portion 22 remains spaced apart from and unsupported by the fixed outboard surface 26 of the inner mandrel 23 to form the final shape of at least a portion of the outboard bead seat 5. A raised shoulder portion 33 of the blank outboard section 32 is spin formed against the shaping surface 25 of the outer mandrel 24 to form the final shape of at least a portion of the outboard retaining flange 7. In this fashion, vehicle wheel 1 is formed integrally as one piece, without requiring multiple spinning operations or a complicated mandrel construction with expandable inserts, or the like.

Figure 1:
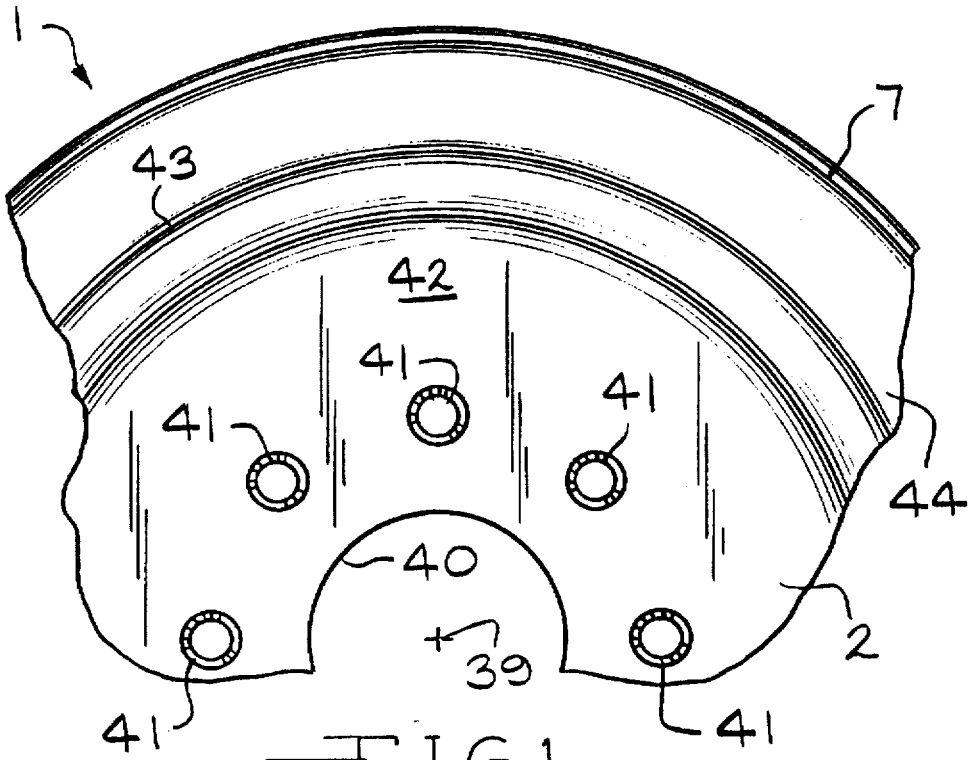
FIG. 1 is a fragmentary, front elevational view of a one-piece vehicle wheel manufactured in accordance with a method embodying the present invention.
Figure 2:
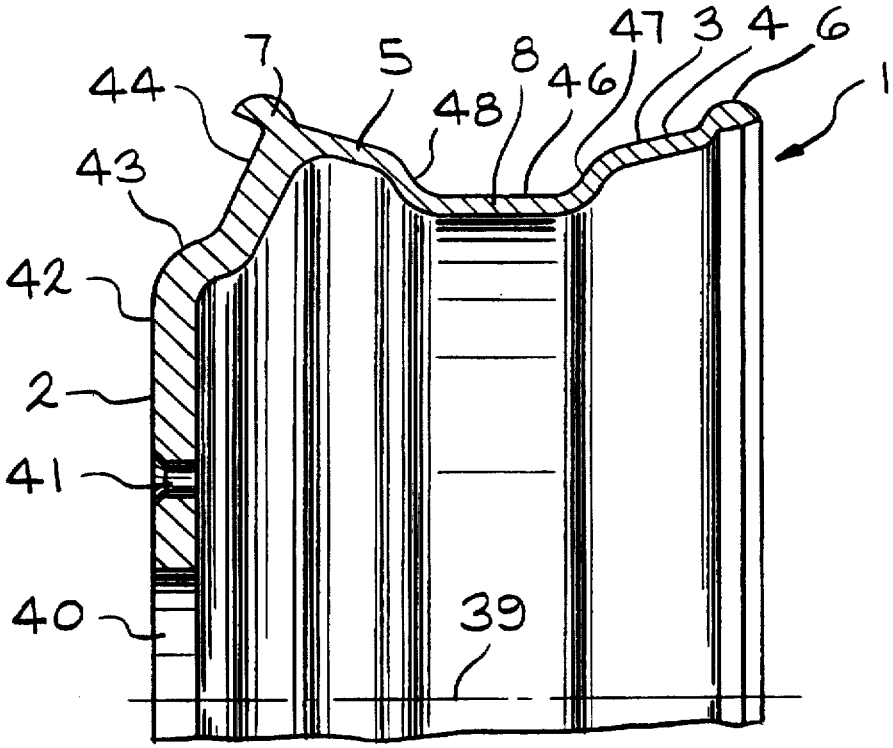
FIG. 2 is a fragmentary, vertical cross-sectional view of the wheel.

With reference to FIGS. 1 and 2, the illustrated vehicle wheel 1 is a truck wheel having a "full face" type of construction, wherein the disc portion 2 extends to the outboard retaining flange 7. The central section 42 of the wheel disc portion 2 has a generally flat annular shape that includes a central pilot opening 40 with a plurality of holes 41 shaped circumferentially thereabout to receive bolts or studs therethrough for mounting wheel 1 to an associated vehicle axle (not shown). The wheel disc portion 2 has a frustroconical shoulder 43 positioned outwardly of annular section 42, which is oriented approximately 40 degrees to the wheel axis. Wheel disc portion 2 also includes a frustroconical section 44 disposed radially outwardly of shoulder 43, which is oriented approximately 60 to 70 degrees to the wheel axis 39. The outboard retaining flange 7 is disposed radially outwardly of frustroconical section 44, and has a generally arcuate outer surface which blends into the outboard bead seat 5. The rim portion 3 of wheel 1 has a generally concave, axial cross-sectional shape, with outboard bead seat 5 and inboard bead seat 6 disposed on opposite sides of rim well 8. Rim well 8 has a base or bottom 46 with opposite sidewalls 47 and 48 extending radially outwardly therefrom. The inboard retaining flange 6 also has a generally arcuate outer surface, similar to that of the outboard retaining flange 7.

Figure 3:
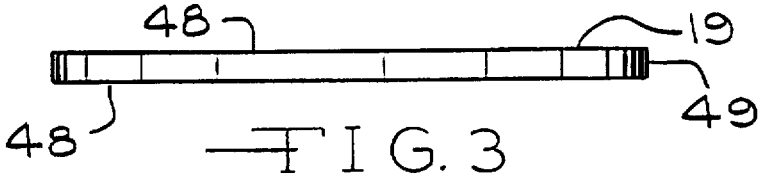
FIG. 3 is a side elevational view of a circular blank for forming the wheel.
Figure 4:
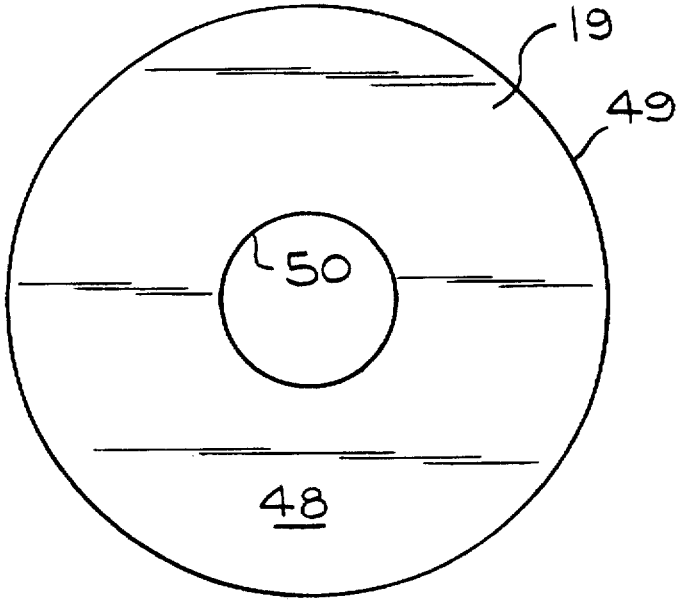
FIG. 4 is a top plan view of the blank.
Figure 5:
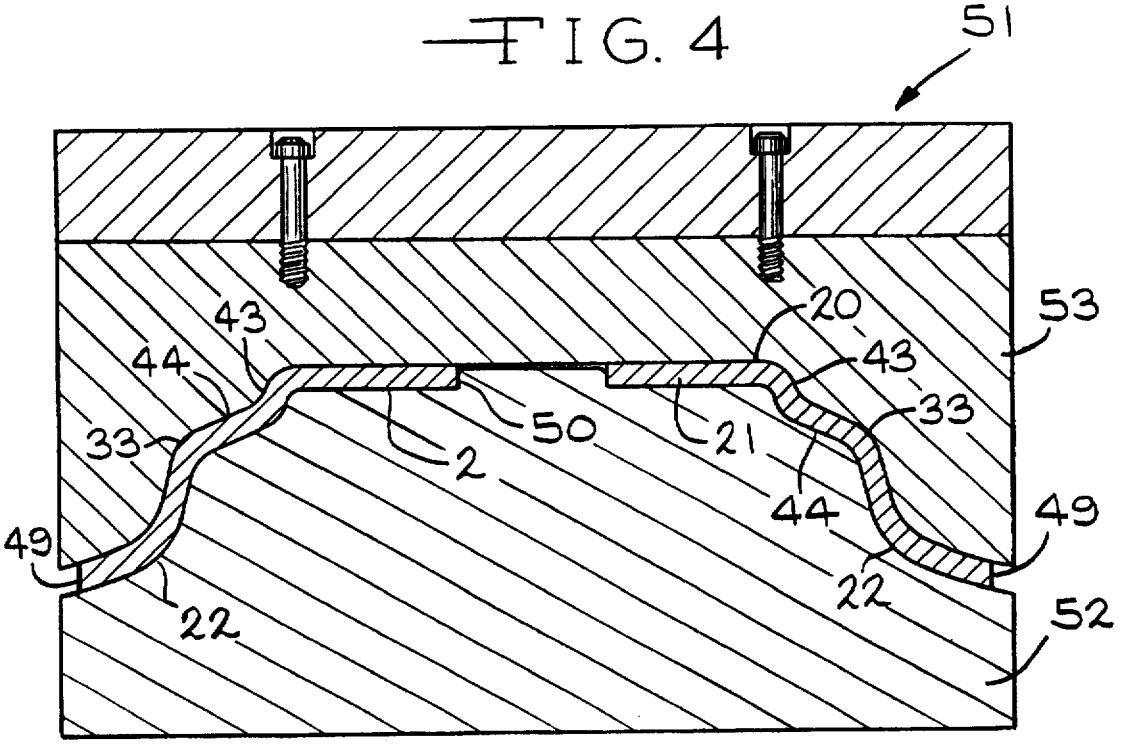
FIG. 5 is a vertical, cross-sectional view of a die shown forming the blank to a preformed shape.
Figures 6A, 6B, 6C:
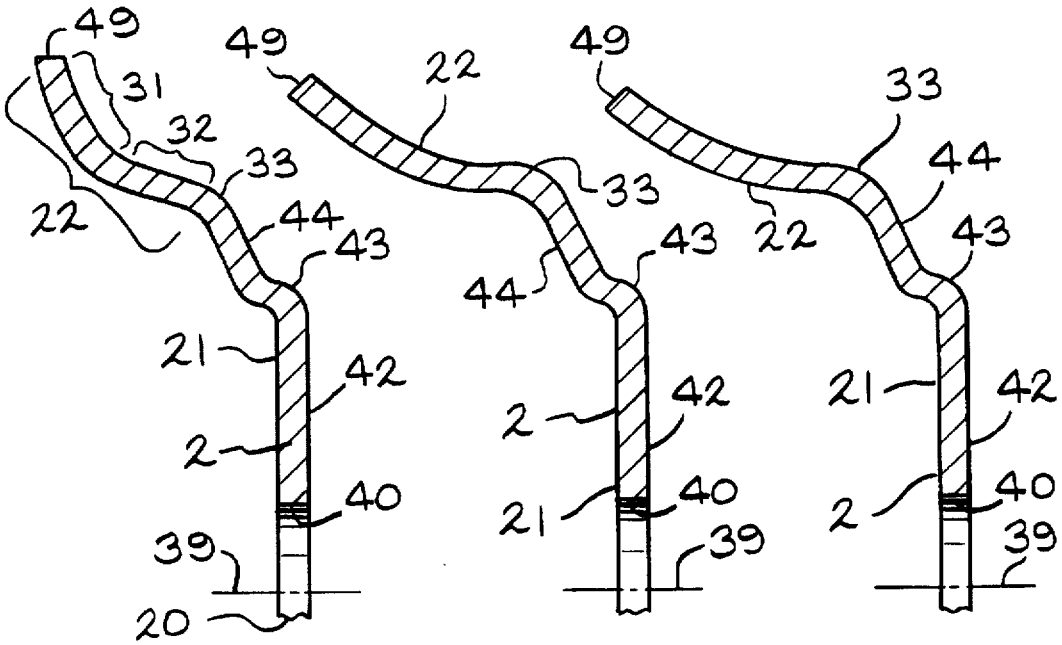
FIG. 6 is a schematic illustration of successive stages of manufacturing the wheel in accordance with the present invention.
Figures 6D, 6E, 6F:
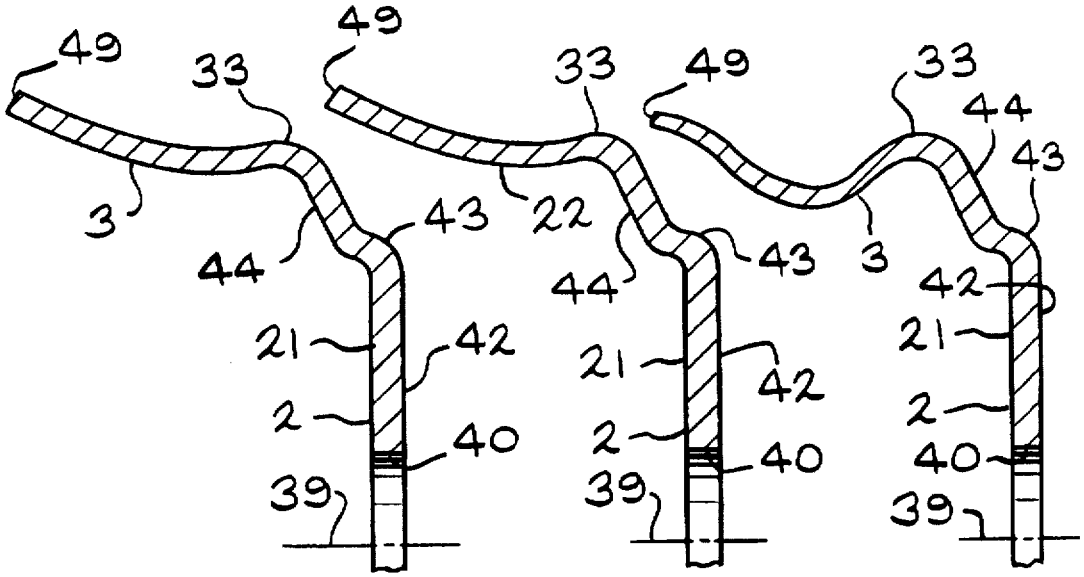
Figure 6G:
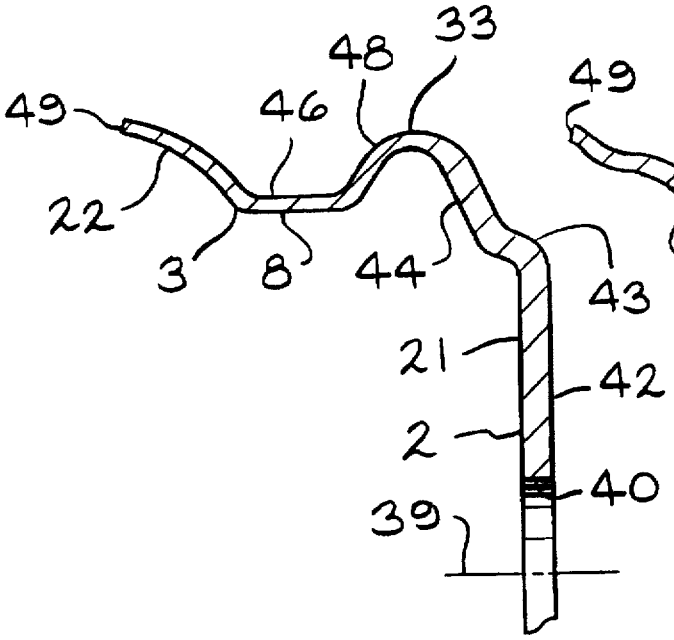
Figure 6H:
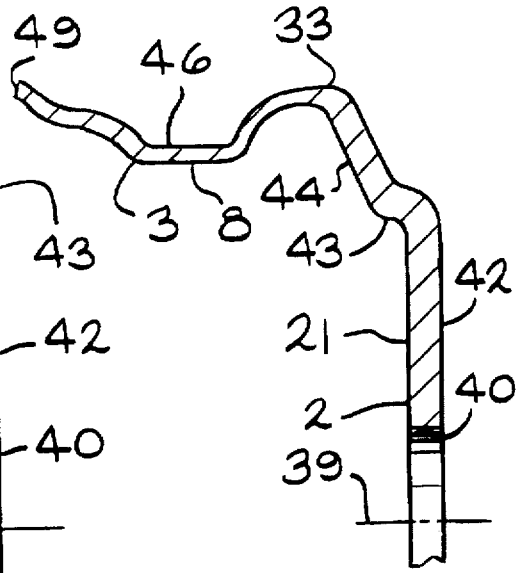
Figure 6I:
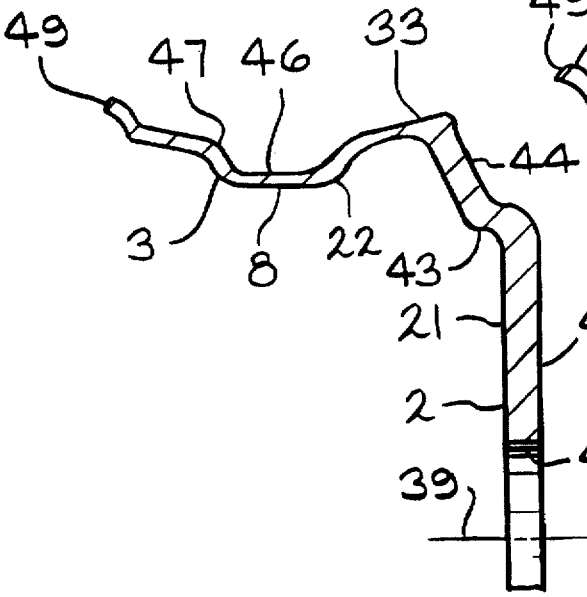
Figure 6J:
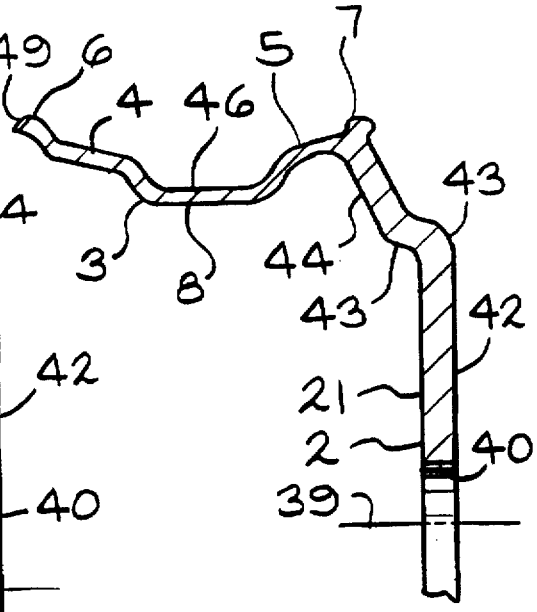
Figure 6K:
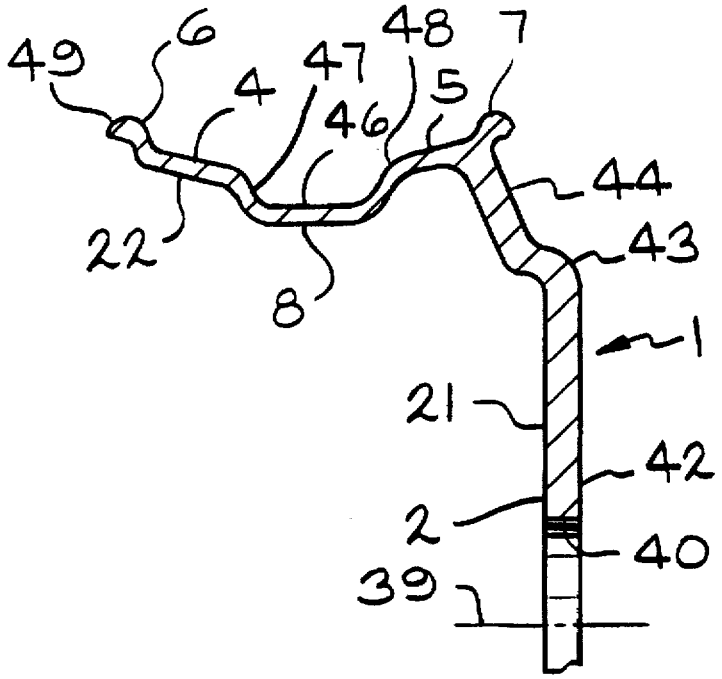
Figure 6L:
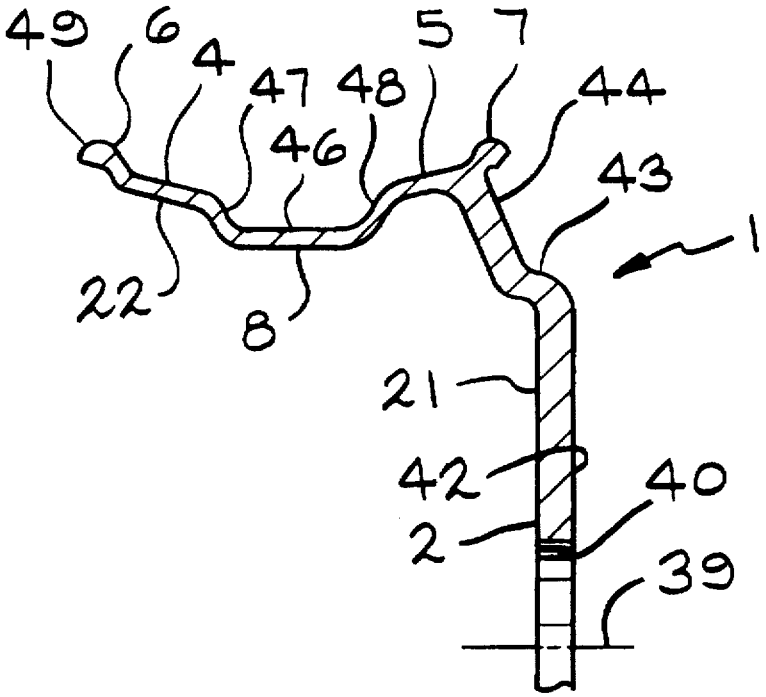

With reference to FIGS. 3–5, the illustrated circular blank 19 used to form one-piece wheel 1 is constructed from a sheet of aluminum having a substantially uniform thickness. In one working embodiment of the present invention, the sheet is 6061 type of aluminum, having a thickness in the range of 0.5–1.0 inches. Circular blank 19 has an annular or doughnut plan shape, with flat, mutually parallel sides or faces 48, an outer edge 49 that ultimately forms at least a portion of the inboard retaining flange 6 of wheel 1, and an inner edge 50 that forms the central pilot hole 40.

In the illustrated method, the circular blank 19 is preformed by pressing the same, such as in the die 51 illustrated in FIG. 5, which includes a male half 52 and a mating female half 53. Preferably, circular blank 19 is first heated to a temperature of approximately 300 to 400 degrees Fahrenheit before being placed in the die 51, so as to avoid work hardening the aluminum material, and otherwise improving the forming process. The circular blank 19 is then formed between the two die halves 52 and 53 by hydraulic pressing, mechanical stamping, or the like into the preformed shape 20 illustrated in FIGS. 5 and 6.

With reference to the first illustration in FIG. 6, in one working embodiment of the present method, the final shapes of sections 42–44 of the wheel disc portion 2 are formed during the preforming step. The peripheral portion 22 of the illustrated preformed blank 20 has an outwardly cupped arcuate shape, and extends from the radially outward end 33 of frustroconical section 44 to peripheral edge 49, which is oriented generally parallel to the wheel axis 39. The blank peripheral portion 22 has an inboard section 31 disposed closest to peripheral edge 49, and an outboard section 32 disposed closest to the outer end 33 of conical section 44. Both inboard section 31 and outboard section 32 are spin formed in the manner described below to create the inboard and outboard bead seats 4 and 5, retaining flanges 6 and 7, and rim well 8.

With reference to FIGS. 7–18, the illustrated preformed blank 20 is spin formed through a series of passes of two forming rollers in the following fashion, so as to complete the shape of wheel 1. A conventional spin forming machine 55 is provided, of the type having a head stock 56 and a tail stock 57 on which inner and outer mandrels 23 and 24 are mounted. The head stock 56 and tail stock 57 can be reciprocated axially with respect to one another to converge and diverge the inner and outer mandrels 23 and 24. The preformed blank 20 is first clamped between the inner and outer mandrels 23 and 24 in the fashion illustrated in FIG. 7, such that the same are concentric about wheel axis 39 (FIG. 6).

A series of draw spinning or "air spinning" steps are then performed on preformed blank 20 by contacting the blank peripheral portion 22 with a first forming roller 30 while the blank 20 is spaced apart from and unsupported by the inner mandrel 23, so as to reduce the thickness of the blank peripheral portion 22 by increasing radial and/or axial length of the preformed blank 20 with respect to the spin axis, without substantial work hardening of the material. In one working embodiment of the present invention, the air spinning process disclosed in commonly assigned U.S. Pat. No. 4,554,810 to Jurus on DRAW-SPINNING OF INTEGRAL VEHICLE WHEEL RIM AND DISC SEGMENTS is employed, which patent is hereby incorporated herein by reference.

The illustrated forming roller 30 is a rough forming roller, which has a three-quarter inch thickness and associated forming diameter, and performs a total of nine passes on preformed blank 20, as described more specifically below. Preferably, the preformed blank 20 is transported directly into spin forming machine 55 from pressing die 50 so that blank 20 is hot during the spin forming operations described below.

FIGS. 8–18 each illustrate a single pass of an associated forming roller over the peripheral portion 22 of preformed blank 20. In FIGS. 8–18, the starting position of the forming roller is shown in broken lines with an arrow thereon indicating the direction of travel, and the finishing position of the forming roller is shown in full lines.

Figure 8:
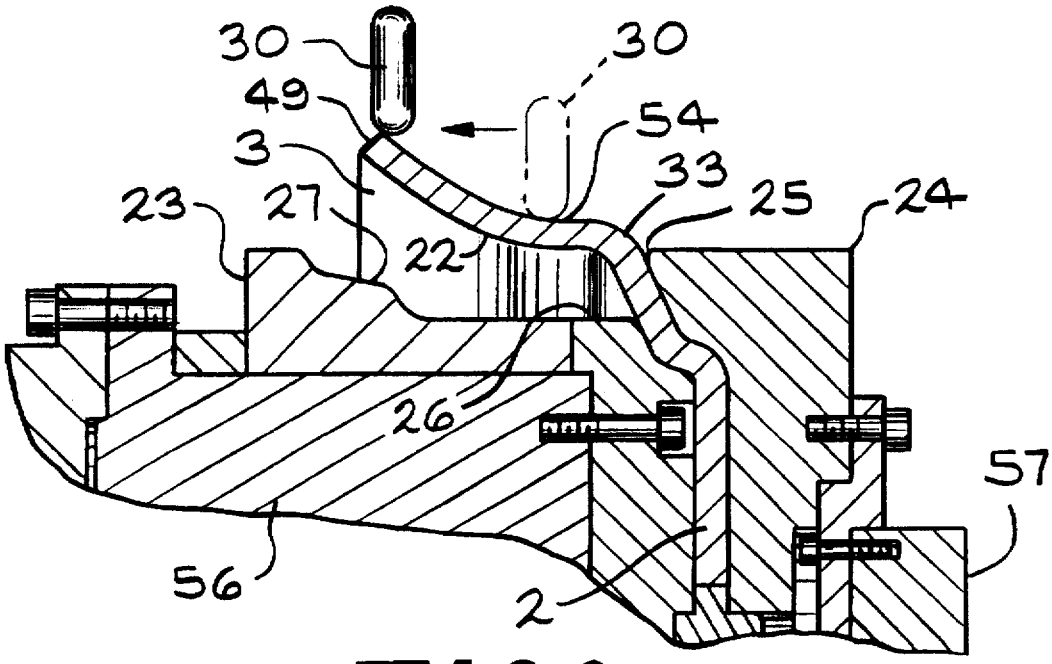
FIG. 8 is a partially schematic, cross-sectional view of the blank and spin forming machine, shown after a first pass of a forming roller.

With reference to FIG. 8, the first pass of rough forming roller 30 acts on blank peripheral portion 22, and begins at a forming point 54 disposed just inboard of the end 33 of frustroconical section 43, and moves in a forward axial direction away from outer mandrel 24 to a point adjacent the outer edge 49 of preformed blank 20. The first pass of rough forming roller 30 is an air spinning step, and generally reduces the thickness of preformed blank 20 along the rim portion 3 of wheel 1, and also starts to flatten out the inboard section 31 of blank peripheral portion 22.

Figure 9:
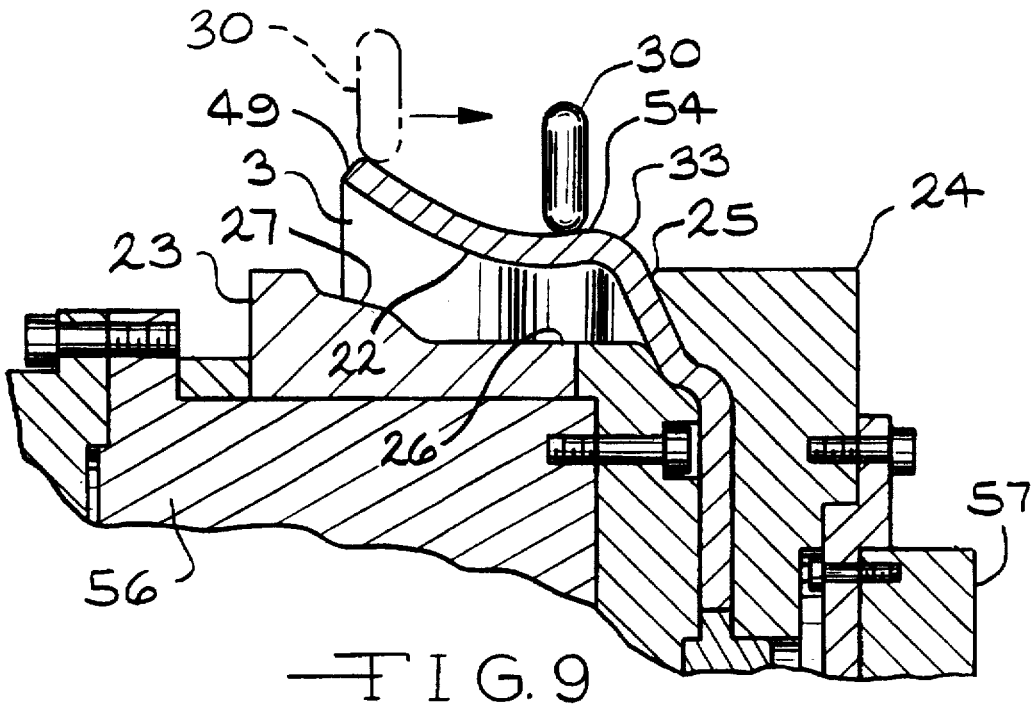
FIG. 9 is a partially schematic, cross-sectional view of the blank and spin forming machine, shown after a second pass of a forming roller.

With reference to FIG. 9, the second pass of rough forming roller 30 also acts on blank peripheral portion 22, and begins adjacent outer edge 49, and moves in a reverse axial direction toward outer mandrel 24 back to the forming point 54, which as noted above, is disposed just inboard of the end 33 of frustroconical section 43. The second pass of rough forming roller 30 is also an air spinning step, and generally reduces the thickness of blank 20 along the rim portion 3 of wheel 1, and further flattens the inboard and outboard sections 31 and 32 of blank peripheral portion 22.

Figure 10:
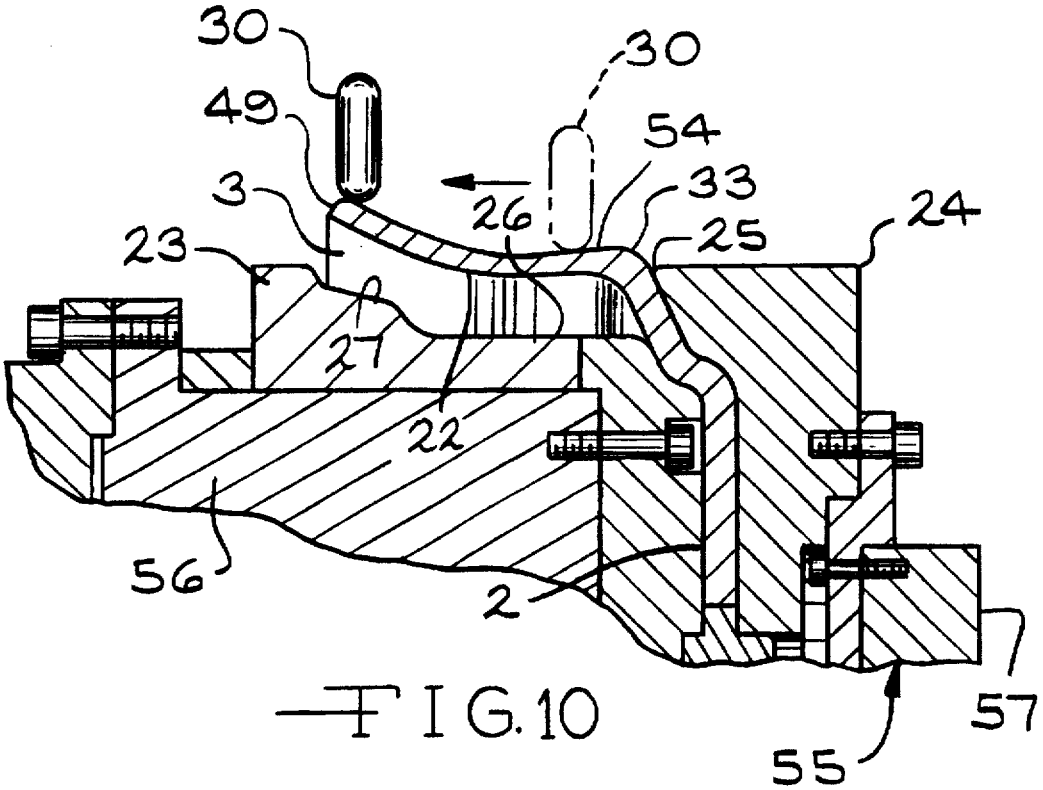
FIG. 10 is a partially schematic, cross-sectional view of the blank and spin forming machine, shown after a third pass of a forming roller.

With reference to FIG. 10, the third pass of rough forming roller 30 also acts on the blank peripheral portion 22, and begins at the forming point 54 adjacent section end 33, and moves in a forward axial direction away from outer mandrel 24 to a point adjacent the outer edge 49 of blank 20. The third pass of rough forming roller 30 is also an air spinning step, and generally reduces the thickness of blank 20 along the rim portion 3 of wheel 1, and further flattens the inboard and outboard sections 31 and 32 of blank peripheral portion 22.

Figure 11:
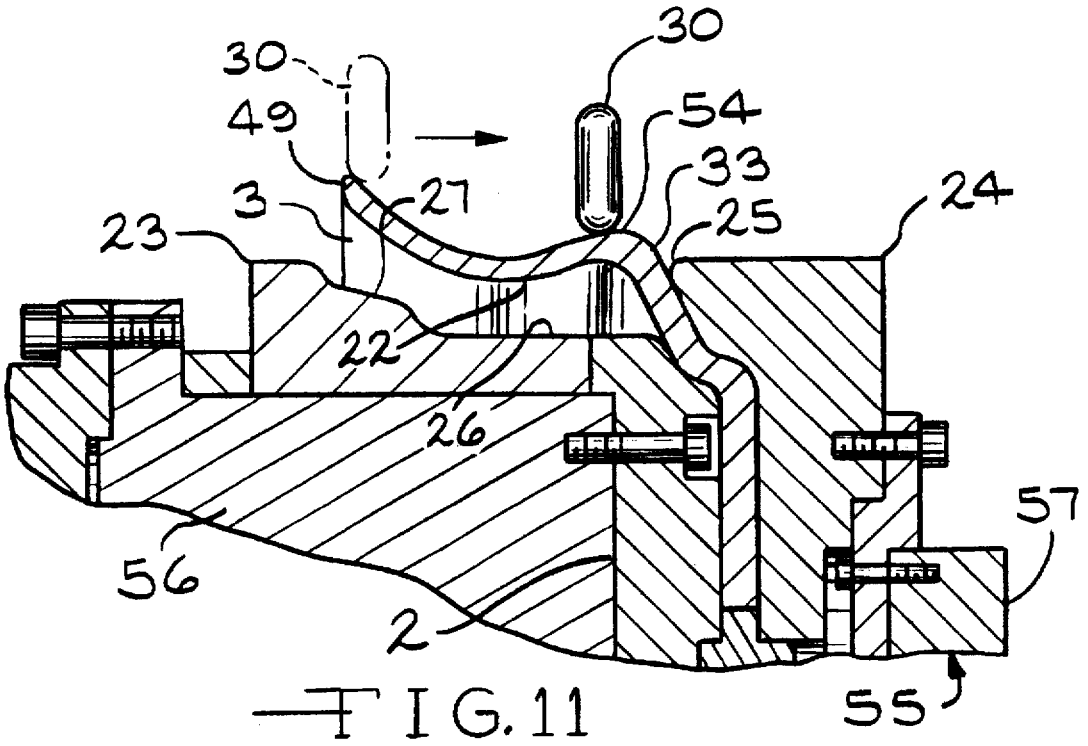
FIG. 11 is a partially schematic, cross-sectional view of the blank and spin forming machine, shown after a fourth pass of a forming roller.

With reference to FIG. 11, the fourth pass of rough forming roller 30 begins adjacent the outer edge 49 of blank 20, and moves in a reverse axial direction toward outer mandrel 24 back to the forming point 54 adjacent section end 33. The fourth pass of rough forming roller 30 is also an air spinning step, and generally reduces the thickness of blank 20 along the rim portion 3 of wheel 1, and further flattens the inboard and outboard sections 31 and 32 of blank peripheral portion 22.

Figure 12:
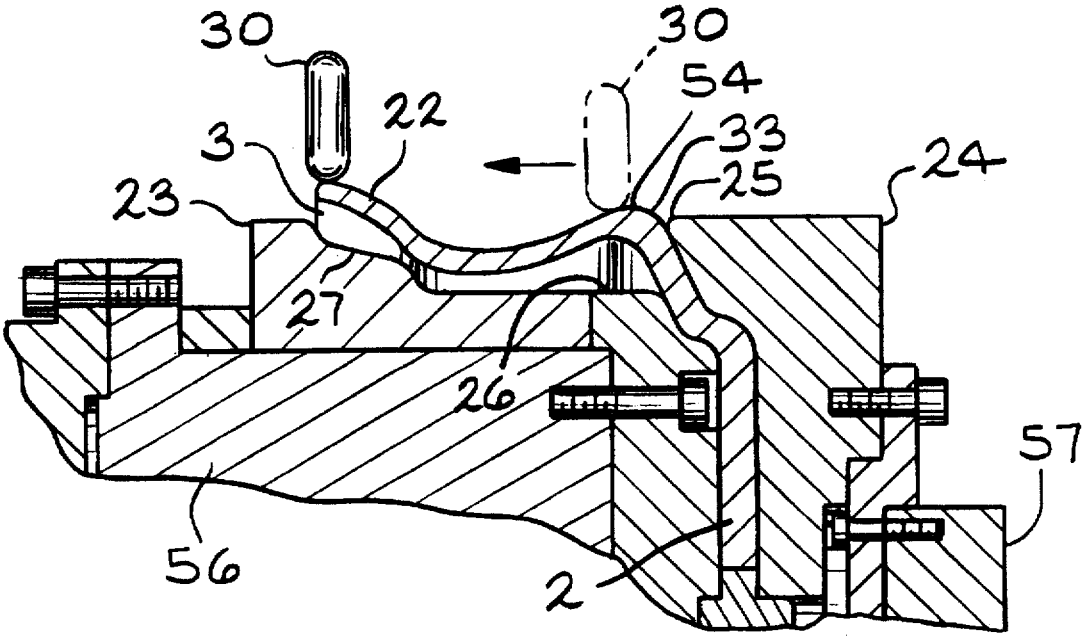
FIG. 12 is a partially schematic, cross-sectional view of the blank and spin forming machine, shown after a fifth pass of a forming roller.

With reference to FIG. 12, the fifth pass of rough forming roller 30 begins at the forming point 54 adjacent section end 33, and moves in a forward axial direction away from outer mandrel 24 to a point over the outer edge 49 of blank 20. The fifth pass of rough forming roller 30 is also an air spinning step, and generally reduces the thickness of blank 20 along the rim portion 3 of wheel 1. The fifth pass of rough forming roller 30 also begins to form the concave shape of rim portion 3, particularly adjacent rim well 8.

Figure 13:
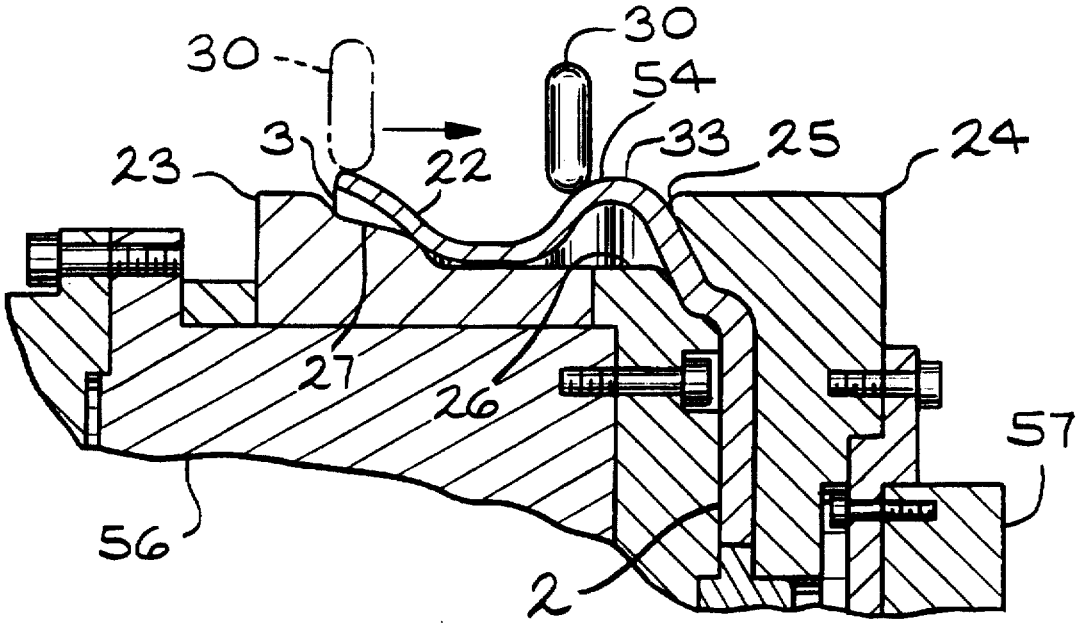
FIG. 13 is a partially schematic, cross-sectional view of the blank and spin forming machine, shown after a sixth pass of a forming roller.

With reference to FIG. 13, the sixth pass of rough forming roller 30 begins adjacent the outer edge 49 of blank 20, and moves in a reverse axial direction toward outer mandrel 24 back to the forming point 54 adjacent section end 33. The sixth pass of rough forming roller 30 is mostly an air spinning step, and reduces the thickness of blank 20 along the rim portion 3 of wheel 1, but also pushes the blank 20 into contact with the inboard shaping surface 27 of inner mandrel 23 at the inboard side 48 of rim well 8, and starts to form the base 46 of the rim well 8. This pass further forms the concave shape of the wheel rim portion 3, and in particular the inclined sides 47 and 48 of rim well 8. It is noteworthy that the outboard side 47 of rim well 8 is formed while the blank peripheral portion 22 remains spaced apart from and unsupported by the fixed outboard surface 26 of the inner mandrel 23. During the sixth forming roller pass, the reverse direction of travel in combination with the radial location of forming roller 30, together push the outer end 33 of frustroconical wheel section 44 on blank 20 laterally outward to a location protruding from the shaping surface 25 of outer mandrel 24 to form a raised shoulder portion 33. Hence, most of the radial diameter of the preformed blank 20 at shoulder portion 33 is retained.

Figure 14:
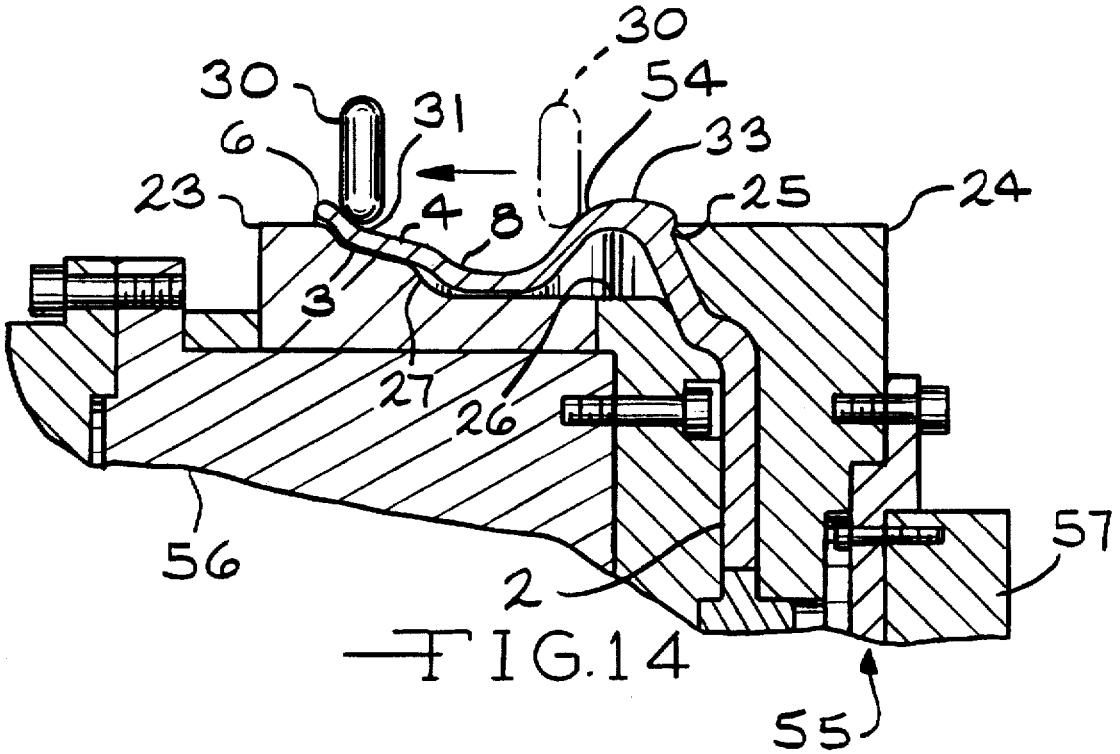
FIG. 14 is a partially schematic, cross-sectional view of the blank and spin forming machine, shown after a seventh pass of a forming roller.

With reference to FIG. 14, the seventh pass of rough forming roller 30 begins at the forming point 54 adjacent raised shoulder 33, and moves in a forward axial direction away from outer mandrel 24 to a point adjacent the outer edge 49 of blank 20. The seventh pass of rough forming roller 30 is an air spinning step only to the point adjacent the inboard sidewall 47 of rim well 8, at which point the blank 20 is pressed closely against the outboard shaping surface 27 of inner mandrel 23 to start to form the final shape of the exterior surface of inboard bead seat 4. During the seventh forming roller pass, the base 46 and outboard sidewall 48 of rim well 8, as well as the outboard bead seat 5, remain spaced apart from inner mandrel 23.

Figure 15:
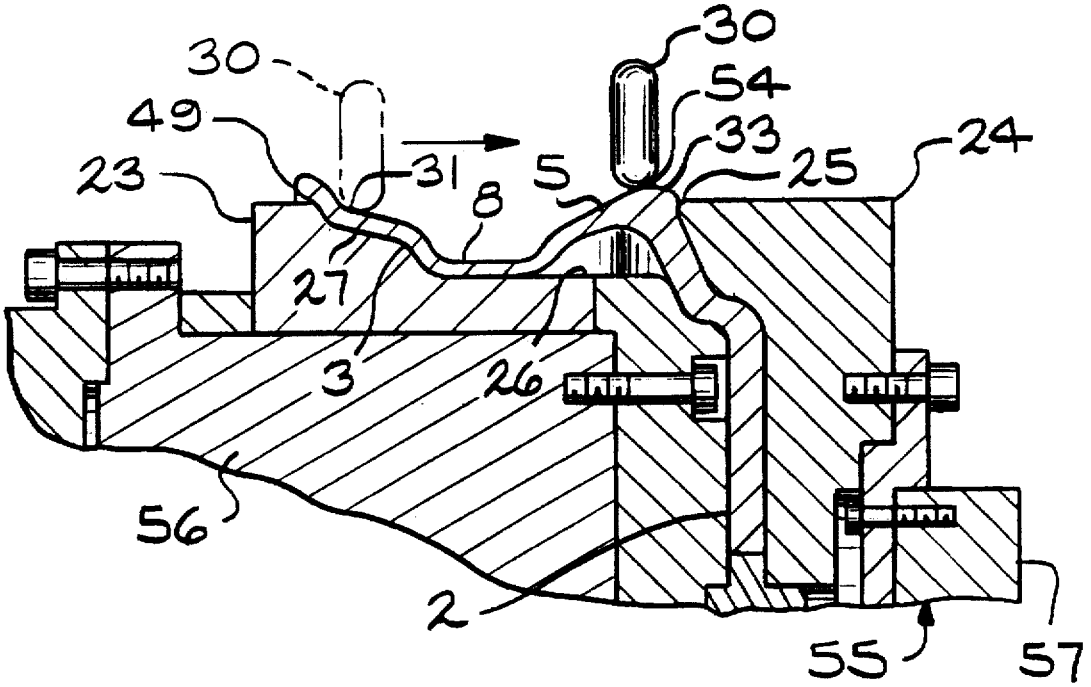
FIG. 15 is a partially schematic, cross-sectional view of the blank and spin forming machine, shown after a eighth pass of a forming roller.

With reference to FIG. 15, the eighth pass of rough forming roller 30 begins adjacent the outer edge 49 of blank 20 and moves in a reverse axial direction toward outer mandrel 24 back to the forming point 54 adjacent raised shoulder portion 33. The eighth pass of rough forming roller 30 also reduces the thickness of blank 20 along the rim portion 3 of wheel 1, and starts to form the final shape of the outer surfaces of the rim well base 46, the outboard sidewall 48 of rim well 8, and the outboard bead seat 5. Once again, it is noteworthy that the continued forming of inboard bead seat 4 and rim well portions 46 and 47 is done while the associated section of blank peripheral portion 22 remains spaced apart from and unsupported by the fixed inboard surface 26 of the inner mandrel 23. Toward the end of the eighth forming roller pass, rough forming roller 30 pinches the raised shoulder portion 33 adjacent forming point 54 between the roller 30 and the outer mandrel 24 to start to form the outboard retaining flange 7.

Figure 16:
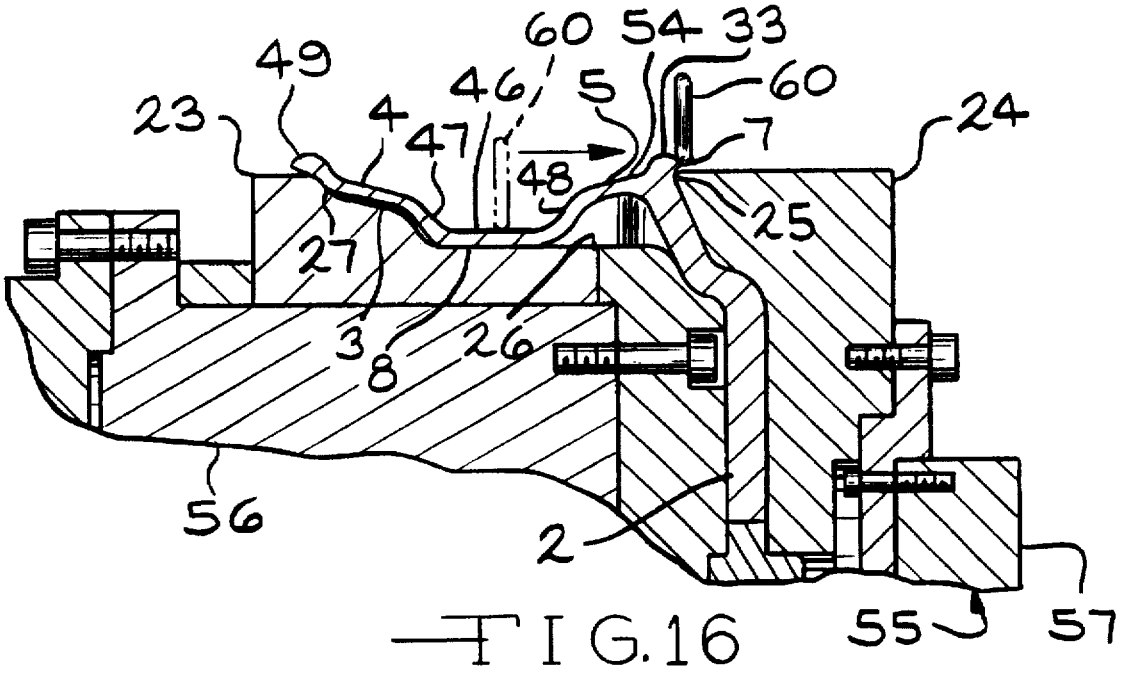
FIG. 16 is a partially schematic, cross-sectional view of the blank and spin forming machine, shown after a ninth pass of a forming roller.
Figure 18:
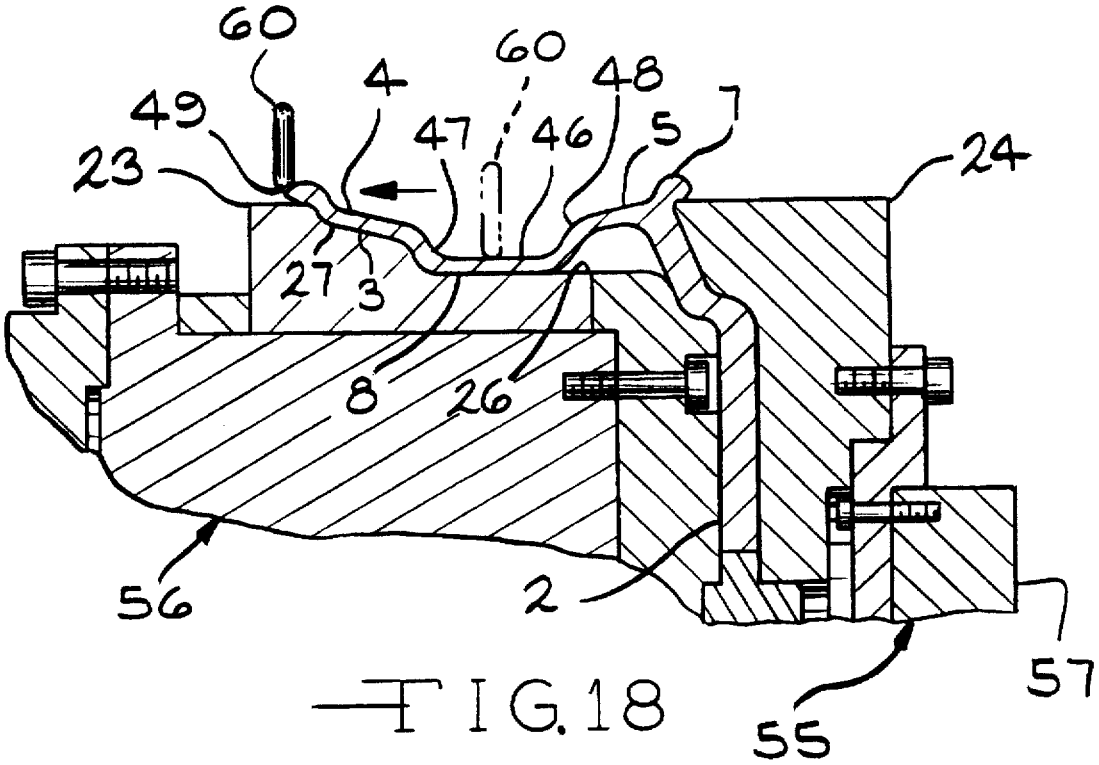
FIG. 18 is a partially schematic, cross-sectional view of the blank and spin forming machine, shown after an eleventh pass of a forming roller.

With reference to FIGS. 16 and 18, a finish forming roller 60 is used to form the final shapes of one-piece wheel 1. In one working embodiment of the present invention, finish roller 60 is generally similar to rough roller 30, except that it has thickness and outer forming diameter of approximately one-quarter inch, instead of the three-quarter inch thickness and rolling diameter of rough forming roller 30.

With reference to FIG. 16, the first pass of finish forming roller 60 begins adjacent the center of rim well bottom 46, and moves in a reverse axial direction toward outer mandrel 24 to a point past the forming point 54, over the shaping surface 25 of outer mandrel 24. The first pass of finish forming roller 60 thus forms the final shape of the outboard sidewall 48 of rim well 8, as well as the outboard bead seat 5 and outboard retaining flange 7. Once again, the formation of rim well 8, outboard bead seat 5 and outboard retaining flange 7 is achieved while the associated section of the blank peripheral portion 22 remains spaced apart from and unsupported by the fixed outboard surface 26 of inner mandrel 23. The arcuate outer surface of outboard retaining flange 7 is formed as the finish forming roller 60 pushes the raised shoulder portion 33 of blank against and over the shaping surface 25 of outer mandrel 24.

Figure 17:
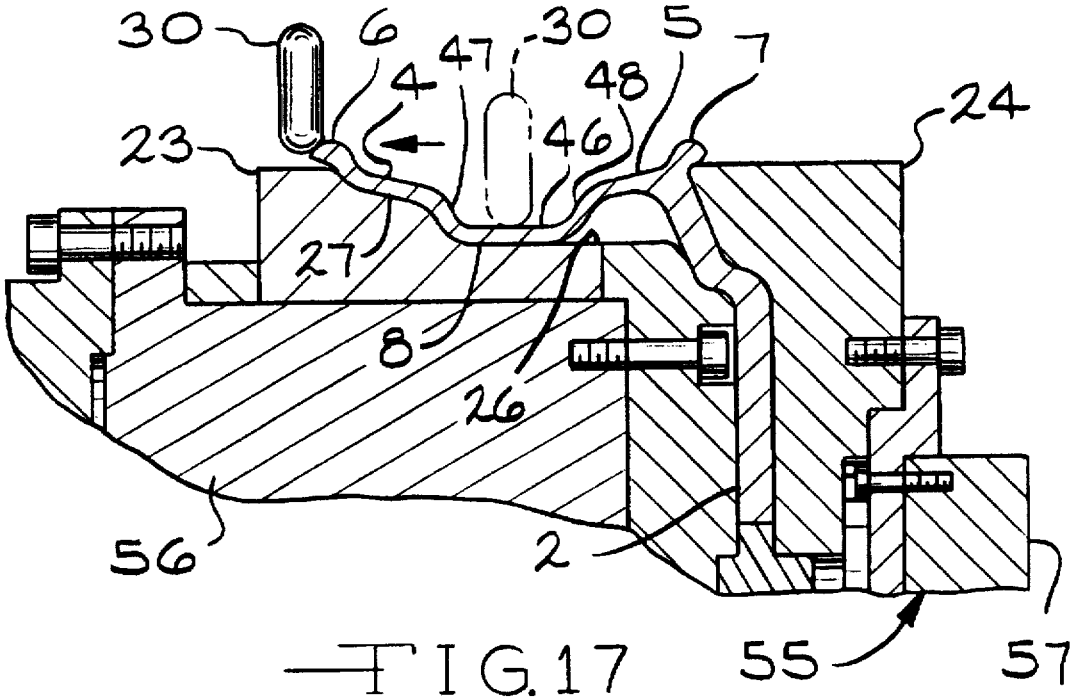
FIG. 17 is a partially schematic, cross-sectional view of the blank and spin forming machine, shown after a tenth pass of a forming roller.

With reference to FIG. 17, the ninth and last pass of rough forming roller 30 begins adjacent the center of rim well bottom 46, and moves in a forward axial direction away from outer mandrel 24 to inboard retaining flange. The first pass of finish forming roller 60 tends to shift or distort the wheel rim portion 3 slightly toward outer mandrel 24, as shown in FIG. 16. The ninth pass of rough forming roller 30 is designed to adjust for any such distortion by pushing the inboard section 31 of wheel rim portion 3 laterally against the inboard shaping surface 27 of inner mandrel 23, as shown in FIG. 17.

With reference to FIG. 18, the second and last pass of finish forming roller 60 begins adjacent the center of rim well bottom 46 and moves in a forward axial direction away from outer mandrel 24 to a point over the inboard retaining flange 6. The second pass of finish forming roller 60 forms the final shape of the bottom 47 and inboard sidewall 47 of rim well 8, as well as the inboard bead seat 4 and inboard retaining flange 6.

The formed wheel 1 can then be easily removed from spin forming machine 55 in the following fashion. The formed wheel 1 is unclamped from machine 55 by separating the inner and outer mandrels 23 and 24 respectively. The formed wheel is then removed from in between the inner and outer mandrels 23 and 24 by pulling the wheel 1 directly off of the inner mandrel 23 in a generally axial direction. Because the outboard sidewall 48 of rim well 8, as well as outboard bead seat 5 and retaining flange 7 are formed while the associated section of the blank peripheral portion 22 remains spaced apart from and unsupported by the fixed outboard surface 26 of the inner mandrel 23, there is no obstruction or obstacle in easily removing formed wheel 1 directly from inner mandrel 23.

It is to be understood that the present invention contemplates various other types and numbers of process steps, which may be somewhat different than those described above with respect to the illustrated embodiment. For example, the preforming of circular blank 19 can be accomplished by spin forming a flat disc, or casting and/or forging preformed blank 20. The final wheel 1 can be machined or edge rolled to obtain certain shapes and/or surface finishes, etc. Other similar modifications are also contemplated by the present invention.

The present method provides a unique, low cost method of spin forming one-piece vehicle wheels 1 and the like. A single spinning operation employs mandrels 23 and 24 with fixed forming surfaces 26 and 27 to minimize expense and repair. The forming rollers 30 and 60 of spin forming machine 55 can be readily programmed to make different shapes such that the present invention is especially suited for making specialty designs and/or low volume runs.

In the foregoing description, it will be readily appreciated by those skilled in the art that modifications may be made to the invention without departing from the concepts disclosed herein. Such modifications are to be considered in the following claims, unless these claims by their language expressly state otherwise.

The embodiments of the invention in which an exclusive property or privilege is claimed are defined as follows:

1. A method of forming a one-piece vehicle wheel of the type having a disc portion and an integral rim portion with inboard and outboard bead seats and retaining flanges and a rim well therebetween, comprising:

providing a generally circular blank;

forming the blank to a preformed shape having a center portion with the final shape of at least a portion of the disc portion of the wheel, and a peripheral portion for spin shaping the final shape of at least a portion of the rim portion of the wheel;

clamping the blank between inner and outer mandrels, wherein the outer mandrel has a shaping surface which conforms to the final shape of at least a portion of the outboard retaining flange, and the inner mandrel has a fixed outboard surface, and an inboard shaping surface which conforms to the final shape of at least a portion of the rim well and the inboard bead seat and flange;

spin forming the peripheral portion of the blank by engaging the same with a forming roller while the blank peripheral portion remains spaced apart from and unsupported by the inboard and outboard shaping surfaces of the inner mandrel, so as to obtain controlled thickness reduction in the unsupported peripheral portion of the blank;

spin forming an inboard section of the blank peripheral portion against the inboard shaping surface of the inner mandrel to form the final shapes of at least a portion of the rim well and the inboard bead seat and flange;

spin forming an outboard section of the blank peripheral portion by engaging the same with a forming roller while the blank peripheral portion remains spaced apart from and unsupported by the fixed outboard surface of the inner mandrel to form the final shape of at least a portion of the outboard bead seat; and spin forming a raised shoulder portion of the blank outboard section against the shaping surface of the outer mandrel to form the final shape of at least a portion of the outboard retaining flange.

2. A method as set forth in claim 1, including:

unclamping the wheel by separating the inner and outer mandrels; and removing the wheel from the inner and outer mandrels by pulling the wheel directly off of the inner mandrel in an axial direction.

3. A method as set forth in claim 2, wherein:

said blank providing step comprises forming the blank from sheet stock of the type having a substantially uniform thickness.

4. A method as set forth in claim 3, wherein:

said blank forming step comprises pressing the blank into the preformed shape.

5. A method as set forth in claim 4, including:

heating the blank prior to forming the blank to its preformed shape.

6. A method as set forth in claim 5, wherein:

said first-named spin forming step includes a plurality of passes of the forming roller.

7. A method as set forth in claim 6, wherein:

said fourth-named spin forming step comprises translating a forming roller over the raised shoulder portion of the blank inner section in a direction toward the outer mandrel.

8. A method as set forth in claim 7, wherein:

said third-named spin forming step comprises translating a forming roller over the outboard section of the blank peripheral portion in a direction toward the outer mandrel.

9. A method as set forth in claim 8, wherein:

said third and forth-named spin forming steps are performed in a single pass of the forming roller.

10. A method as set forth in claim 9, wherein:

said first-named spin forming step is performed prior to said second, third and fourth-named spin forming steps.

11. A method as set forth in claim 10, wherein:

said second-named spin forming step is performed prior to said third and fourth-named spin forming steps.

12. A method as set forth in claim 11, wherein:

said third-named spin forming step is performed prior to said fourth-named spin forming step.

13. A method as set forth in claim 12, wherein:

said blank forming step comprises forming the blank from aluminum sheet stock.

14. A method as set forth in claim 13, wherein:

said blank pressing step comprises stamping.

15. A method as set forth in claim 1, wherein:

said blank providing step comprises forming the blank from sheet stock of the type having a substantially uniform thickness.

16. A method as set forth in claim 1, wherein:

said blank forming step comprises pressing the blank into the preformed shape.

17. A method as set forth in claim 1, including:

heating the blank prior to forming the blank to its preformed shape.

18. A method as set forth in claim 1, wherein:

said first-named spin forming step includes a plurality of passes of the forming roller.

19. A method as set forth in claim 1, wherein:

said fourth-named spin forming step comprises translating a forming roller over the raised shoulder portion of the blank outboard section in a direction toward the outer mandrel.

20. A method as set forth in claim 1, wherein:

said third-named spin forming step comprises translating a forming roller over the outboard section of the blank peripheral portion in a direction toward the outer mandrel.

21. A method as set forth in claim 1, wherein:

said third and forth-named spin forming steps are performed in a single pass of the forming roller.

22. A method as set forth in claim 1, wherein:

said first-named spin forming step is performed prior to said second, third and fourth-named spin forming steps.

23. A method as set forth in claim 1, wherein:

said second-named spin forming step is performed prior to said third and fourth-named spin forming steps.

24. A method as set forth in claim 1, wherein:

said third-named spin forming step is performed prior to said fourth-named spin forming step.

25. A method as set forth in claim 1, wherein:

said blank providing step comprises forming the blank from aluminum sheet stock.

26. A method as set forth in claim 1, wherein:

said blank forming step comprises stamping the blank into the preformed shape.

27. In a method of forming a vehicle wheel of the type having a disc portion and a rim portion with inboard and outboard bead seats and retaining flanges and a rim well therebetween, comprising:

providing a generally circular blank having a center portion with the final shape of at least a portion of the disc portion of the wheel, and a peripheral portion for spin shaping the final shape of at least a portion of the rim portion of the wheel;

positioning the blank between inner and outer mandrels, wherein the inner mandrel has a fixed outboard surface, and an inboard shaping surface which conforms to the final shape of at least a portion of the rim well and the inboard bead seat and flange;

spin forming an inboard section of the blank peripheral portion against the inboard shaping surface of the inner mandrel to form the final shape of at least a portion of the rim well and the inboard bead seat and flange;

spin forming an outboard section of the blank peripheral portion by engaging the same with a forming roller while the blank peripheral portion remains spaced apart from and unsupported by the fixed outboard surface of the inner mandrel to form the final shape of at least a portion of the outboard bead seat.

28. A method as set forth in claim 27, including:

spin forming the peripheral portion of the blank by engaging the same with a forming roller while the blank peripheral portion remains spaced apart from and unsupported by the inboard and outboard shaping surfaces of the inner mandrel, so as to obtain controlled thickness reduction in the unsupported peripheral portion of the blank.

29. A method as set forth in claim 27, including:

spin forming a raised shoulder portion of the blank inner section against the shaping surface of the outer mandrel to form the final shape of at least a portion of the outboard retaining flange.

30. A method as set forth in claim 27, including:

separating the inner and outer mandrels; and removing the wheel from the inner and outer mandrels by pulling the wheel directly off of the inner mandrel in an axial direction.

31. A method as set forth in claim 27, wherein:

said blank providing step comprises forming the blank from aluminum sheet stock of the type having a substantially uniform thickness.

32. A method as set forth in claim 27, wherein:

said blank providing step comprises pressing the blank into the preformed shape.

33. A method as set forth in claim 27, including:

heating the blank prior to pressing the blank into its preformed shape.

34. A method as set forth in claim 27, wherein:

said first-named spin forming step includes a plurality of passes of the forming roller.

35. A method as set forth in claim 27, wherein:

said second-named spin forming step comprises translating a forming roller over the outboard section of the blank peripheral portion in a direction toward the outer mandrel.

36. A method as set forth in claim 27, wherein:

said second and third-named spin forming steps are performed in a single-pass of the forming roller.

* * * * *